US005192972A

United States Patent [19]

Kroll et al.

[11] Patent Number: 5,192,972

[45] Date of Patent: Mar. 9, 1993

[54] DEVELOPER MIX MONITORING FOR COLOR DEVELOPER STATIONS

[75] Inventors: Arthur S. Kroll; Wunan Chang, both of Rochester, N.Y.

[73] Assignee: Eastman Kodak Company, Rochester, N.Y.

[21] Appl. No.: 632,677

[22] Filed: Dec. 24, 1990

[51] Int. Cl.[5] ..... G03G 21/00

[52] U.S. Cl. ..... 355/208; 355/246; 355/326

[58] Field of Search ..... 355/203, 204, 207, 208, 355/246, 326, 327, 200

[56] References Cited

U.S. PATENT DOCUMENTS

| | | | |
|---|---|---|---|
| 3,797,930 | 3/1974 | Tanaka et al. | 355/4 |
| 4,082,445 | 4/1978 | Steiner | 355/14 |
| 4,275,134 | 6/1981 | Knechtel | 430/44 |
| 4,620,783 | 11/1986 | Tanaka et al. | 355/14 |
| 4,622,916 | 11/1986 | Tanaka et al. | 118/688 |
| 4,728,983 | 3/1988 | Zwadlo et al. | 355/4 |
| 4,916,488 | 4/1990 | Kimura | 355/208 |
| 4,928,146 | 5/1990 | Yamada | 355/253 |
| 4,932,356 | 6/1990 | Watanabe et al. | 355/208 X |
| 4,956,668 | 9/1990 | Arnold et al. | 355/208 |
| 4,956,669 | 9/1990 | Nakamura | 355/207 X |

FOREIGN PATENT DOCUMENTS

| | | | |
|---|---|---|---|
| 0212967 | 9/1988 | Japan | 355/207 |
| 1-244477 | 9/1989 | Japan . | |

*Primary Examiner*—A. T. Grimley
*Assistant Examiner*—Christopher Horgan

[57] ABSTRACT

A toner monitor in an electrostatographic machine is automatically calibrated when a toner monitor is periodically caused to read a simulated nominal toner concentration. Any difference between the monitor's output and that expected for the simulated nominal toner concentration is applied to a compensation device. The simulated nominal toner concentration signal is obtained by periodic alignment of the toner monitor with a magnetically permeability member.

20 Claims, 3 Drawing Sheets

DEVELOPER MIX MONITORING FOR COLOR DEVELOPER STATIONS

CROSS REFERENCE TO RELATED APPLICATION

This application is related to U.S. patent application Ser. No. 07/621,681, filed in the names of Kroll et al on Dec. 3, 1990.

BACKGROUND OF THE INVENTION

1. Technical Field

This invention relates generally to developer mix monitors for electrostatographic machines, and more particularly to such machines capable of developing a series of electrostatic images with different toners, for example, different color toners.

2. Background Art

U.S. Pat. No. 4,928,146 issued to Yamada on May 22, 1990, is illustrative of a number of references which show the development of a series of electrostatic images carried on a photoconductive drum with different colored toners at a single development position. See also, U.S. Pat. No. 3,797,930, Tanaka et al, issued Mar. 17, 1974; U.S. Pat. No. 4,275,134, Knechtel, issued June 23, 1981; Japanese Kokai 1-244477 (1989); U.S. Pat. No. 4,728,983, Zwaldo, issued Mar. 1, 1988. A series of four development units are moved one after another to the development position. Each unit develops an image and is replaced by another unit as the series of units is indexed to apply a different color toner to the next image. The series of units are arranged side-by-side and moved linearly through a position in which the unit to be used is aligned with the development position. After or as it is aligned, a cam is rotated to push the entire unit toward the development position, generally moving transverse to the motion of the series of units. Other references show the units arranged on a rotary support with the units being rotated through alignment with the development position.

This general approach has the advantage of utilizing only a single development position for applying four different color toners to electrostatic images. This permits the use of development units whose size and number would prohibit them being spaced around the periphery of a relatively small photoconductive drum. It thus also permits the use of a small photoconductive drum. The use of a small drum has many advantages including both reduced expense and reduced size of the apparatus. U.S. patent application Ser. No. 07/621,681, filed in the names of Kroll et al on Dec. 3, 1990, relates to such apparatus.

Electrostatographic machines generally uses a two-component developer mix comprised of a toner powder and a magnetizable carrier material. During the use of the apparatus, toner powder has to be replenished in a quantity necessary to compensate for the consumption of toner powder used for the development of images. Various automatic toner replenishment systems are known wherein a signal representative of the detected concentration of toner powder in the developer mix is compared with a reference signal corresponding to a predetermined reference toner concentration. When the detected concentration is lower than the reference concentration, replenishment occurs.

U.S. Pat. No. 4,620,783 discloses a color copier having a plurality of development units indexable into alignment with a photoconductive drum. A single toner monitor is provided for ascertaining the ration of toner particles to carrier particles in the development mixture of the particular development unit aligned with the drum. No provision is made for compensation for long-term variables (noise) in the monitored signal, such as noise due to the thermal characteristics of the monitor, contamination, mechanical misalignment of structural parts, pressure changes between the monitor and the toning station walls, etc.

DISCLOSURE OF INVENTION

It is the object of the invention to provide both method and apparatus for developing a series of electrostatic images with different toners with means for calibrating the monitor to compensate for long-term changes in system noise.

A toner monitor in an electrostatographic machine is automatically calibrated when a toner monitor is periodically caused to read a simulated nominal toner concentration. Any difference between the monitor's output and that expected for the simulated nominal toner concentration is applied to a compensation device.

In a preferred embodiment of the present invention, the simulated nominal toner concentration signal is obtained by periodic alignment of the toner monitor with a member having a known magnetic permeability, and which is always stable with respect to different environments. In apparatus in which a plurality of developer units are fixed with respect to each other and are moved to align the respective units one after another with a development position, the toner monitor is caused to align with the member of known permeability at a position of the development unit intermediate positions of alignment of two of the developer units with the toner monitor. The output of the toner monitor is compared to a target signal, and any error is assumed to be the result of system variables; to be factored into subsequent toner concentration readings.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
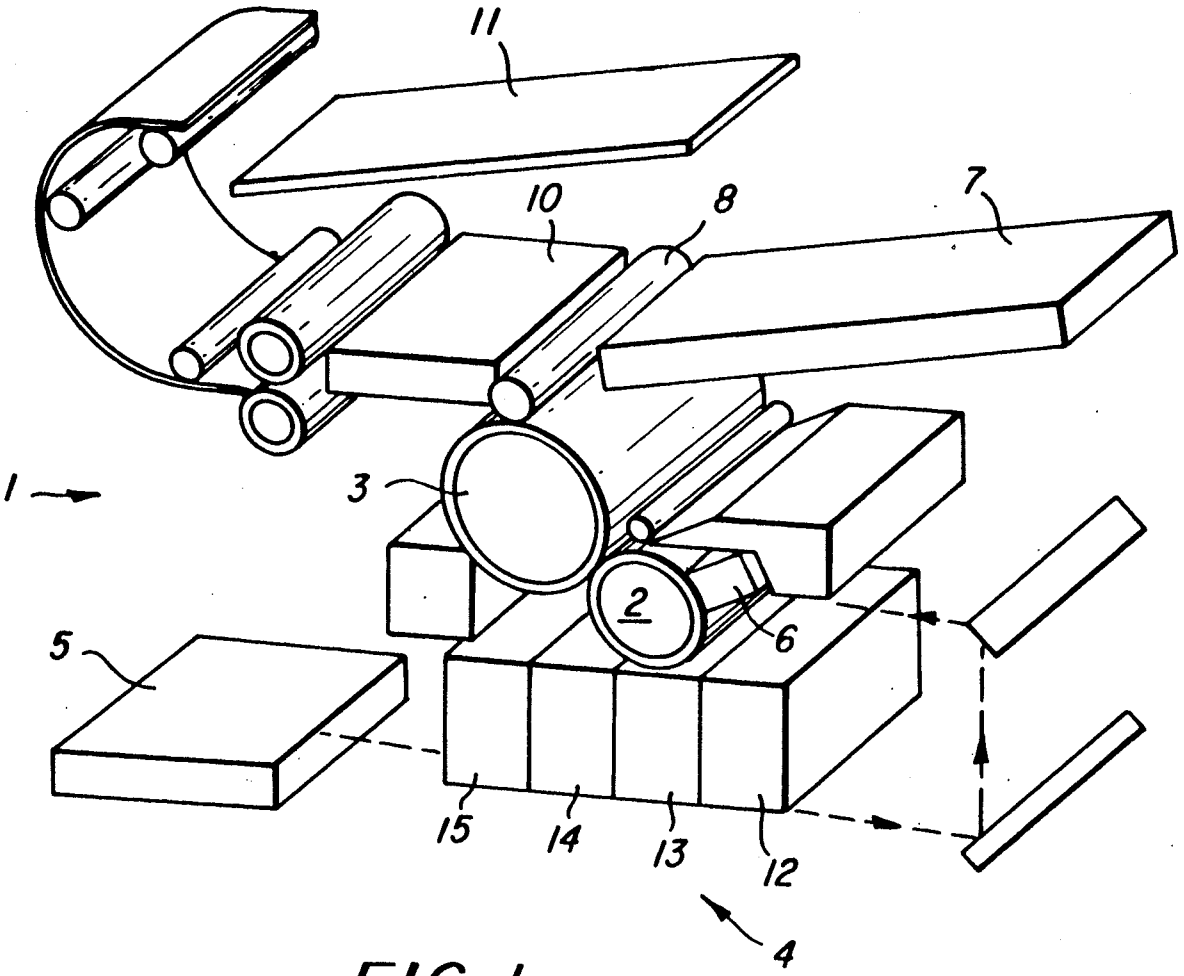
FIG. 1 is a front perspective view of a preferred embodiment of an electrostatographic machine of the present invention.

According to FIG. 1, an electrophotographic color printer 1 includes a photoconductive drum 2 mounted for rotation past a series of stations to create multicolor toner images on a transfer roller 3 or on a receiving sheet carried by transfer roller 3, according to a process well known in the art. More specifically, drum 2 is uniformly charged at a charging station 6, imagewise exposed at an exposure station, for example by a laser exposure station 5, to create a series of electrostatic images.

The electrostatic images are developed by a developing device 4, which applies a different color toner to each of the series of images to form a series of different color toner images. The series of toner images are then transferred in registration to a surface associated with transfer roller 3 to create a multicolor toner image. The surface associated with roller 3 can either be the surface of transfer roller 3 or the outside surface of a receiving sheet secured to the surface of roller 3. If the multicolor image is formed directly on the surface of transfer roller 3, it is best utilized by being transferred to a receiving sheet from a supply 7 at a position 8 remote from drum 2. The transferred image is fused at 10, and the finished sheet is stacked at 11.

Photoconductive drum is made quite small, its periphery being substantially smaller than a single image. A small photoconductive drum allows it to be easily replaced. It also contributes to a reduction of the size and cost of the printer 1. Unfortunately, smallness in the photoconductive drum makes application of different color toners to consecutive electrostatic images difficult to accomplish geometrically. Similar to prior art cited above, printer 1 solves this problem by moving a series of four development units 12–15 through a development position allowing each of the electrostatic images to be toned by a different developing unit but using only a single developing position associated with drum 2.

According to FIG. 1, the development units are all fixed in a laterally movable carriage supported on guide rails, not shown, for linear movement in a horizontal direction below drum 2. Details of the cartridge and the development units are fully disclosed in the above-identified, co-pending U.S. patent application, the disclosure of which is hereby specifically incorporated by reference into this specification.

Figure 2:
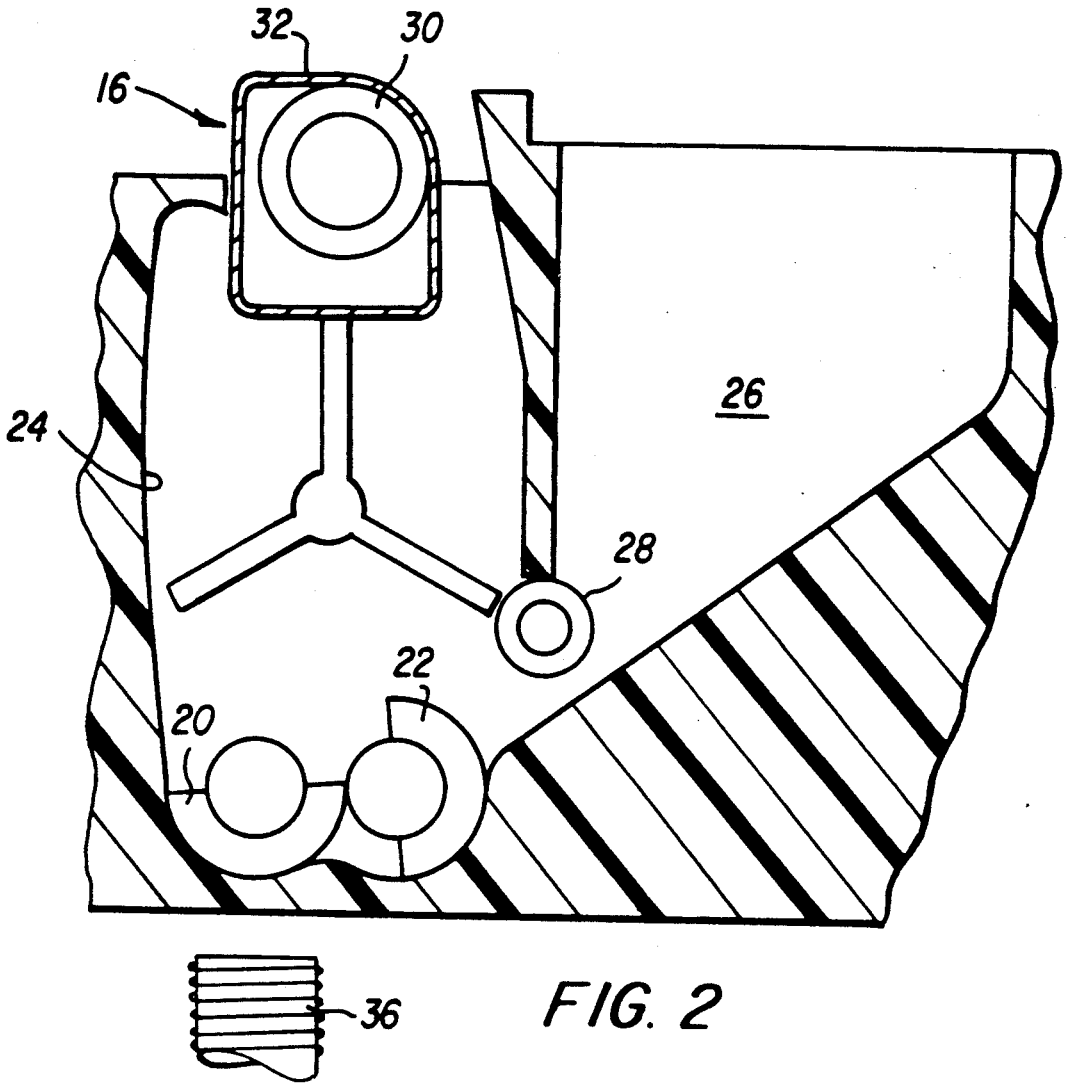
FIG. 2 is a rear cross-sectional view of a more detailed showing of a development unit usable in the electrostatographic machine shown in FIG. 1.

Referring to FIG. 2, a developing unit 12 includes an applicator 16 and a mixing device such as paddle 18 and augers 20, 22. The mixing device is located in a development chamber 24 which contains a mixture of hard magnetic carrier particles and insulating toner particles. A supply of toner particles is contained in a toner chamber 26. Toner particles are fed from toner chamber 26 to development chamber 24 by a toner feed roller 28. Construction and operation of the developing unit is essentially the same as the unit described in the above-identified, co-pending U.S. patent application.

In operation, rotation of paddle 18 and augers 20, 22 cause both the mixing of developer in chamber 24 and a raising of the level of that developer making it accessible to the magnetic field of applicator 16. Applicator 16 includes a rotatable magnetic core 30 and a stationary sleeve 32. Hard magnetic carrier particles move around the sleeve in response to rotation of the core bringing the developer through the developing position. The developer is moved by the rotating core at essentially the same speed as the electrostatic image is moving on rotating drum 2 providing high quality development of the electrostatic image.

Figure 3:
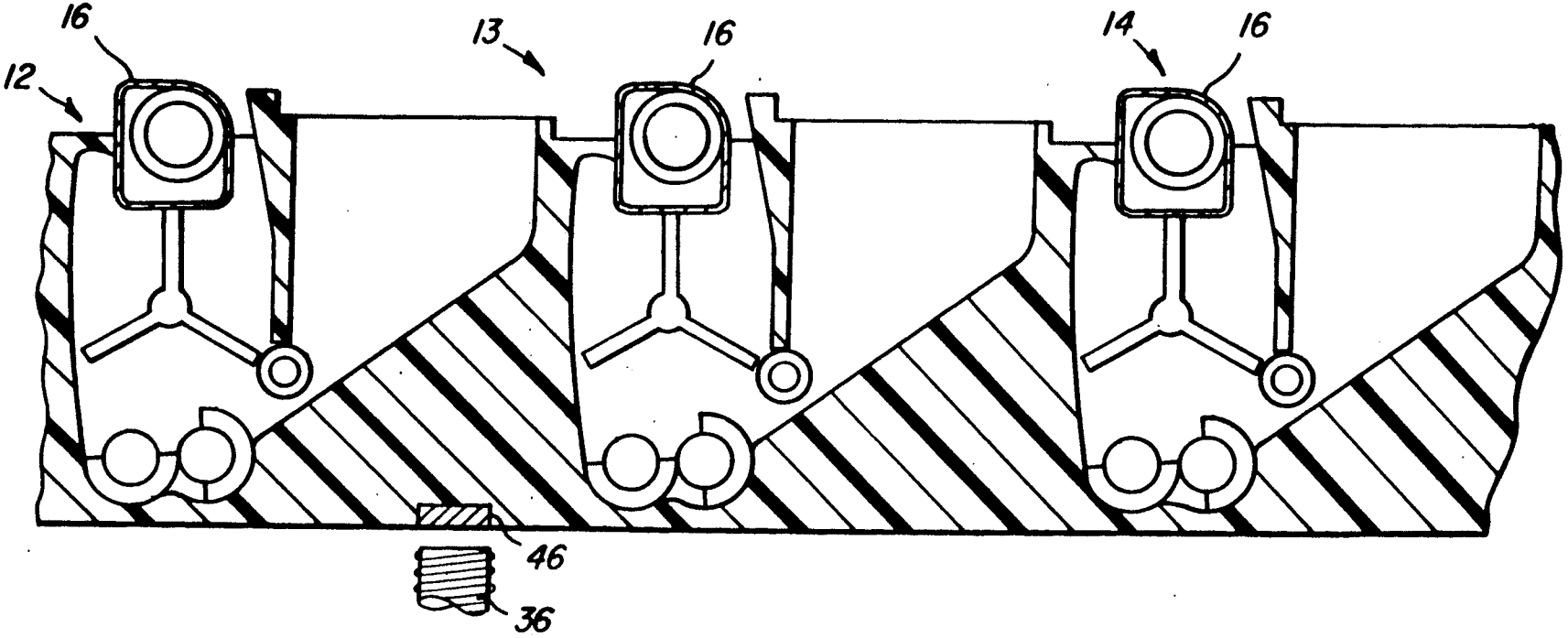
FIG. 3 is a rear cross-sectional view of a development device formed of a plurality of development units shown in FIG. 2.

Referring to FIG. 3, a plurality of development units 12–15, which are of essentially the same construction, form development device 4. After development of a first electrostatic image, a motor, not shown, is actuated to drive developing device 4 to the right, as illustrated, until applicator 16 of developing unit 13 becomes aligned with the exposure position for toning a second electrostatic image. The process is repeated for developing units 14 and 15. The motor is reversed after all four images have been toned, and toning device 4 is returned to the left to its original position.

Figure 4:
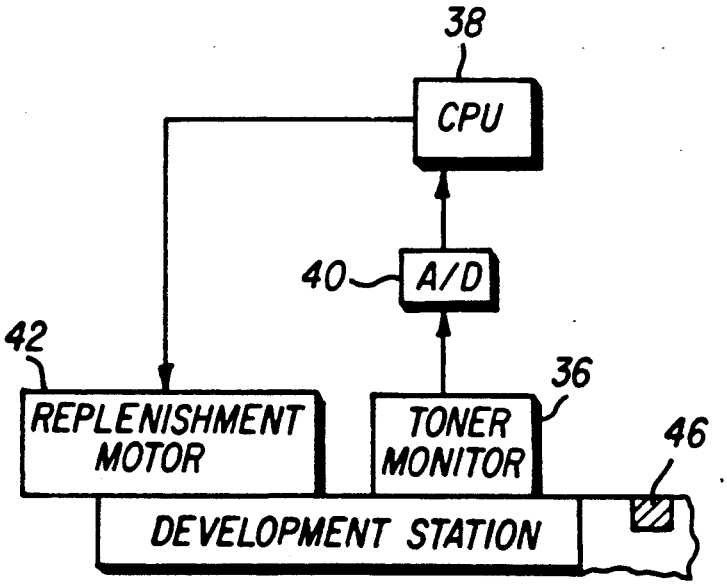
FIG. 4 is a block diagram showing control architecture for monitoring the development device of FIG. 3 and for replenishing toner to the development units.

A toner monitor 36 is provided in a fixed position below toning device 4 such that the developing unit 12–15 which is at the developing position of drum 2 is aligned with the monitor. The toner monitor and replenishment control will be described with respect to FIG. 4. This control circuit includes a central processor unit 38 and toner monitor 36 for detection of the toner concentration within chamber 24 of each developing unit. Toner monitor 36 may be chosen from several commercially available products, such as, for example, those responsive to changes in effective permeability of two component developers and manufactured by Hitachi Metals, Ltd. Toner monitor 36 emits an analog signal which is representative of the permeability in the developer mix, and thus representative of the toner concentration. The signal is digitized at an analog-to-digital converter 40 and inputted to a port of central processing unit 38.

Central processing unit 38 has an output port connected to a toner replenishment motor 42. The toner replenishing motor is used to drive toner dispensing roller 28 (FIG. 2) in accordance with a suitable algorithm which compares the toner concentration signal from analog-to-digital converter 40 to a reference signal corresponding to a predetermined reference toner concentration. The reference value is unique for each developing unit 12–15, and is preferably derived from the output signal of the toner monitor when aligned with a toning station immediately after it has been first loaded into developing device 4. The four different toning station reference values are stored in memory in central processing unit 38. When the detected concentration of any station is lower than the reference concentration, the replenishment motor for that station is activated.

As set forth above, variables associated with the measurement of the toner concentration in development units 12–15 can interject error in the output of toner monitor 36. According to the present invention, means are provided for calibrating the toner monitor to compensate for such variables.

A member 46 having known permeability is positioned in developing device 4 such that member 46 aligns with toner monitor 36 as the developing device shifts between its positions aligning developing units 12 and developing units 13 with the developing position. FIG. 3 shows the developing device in its position aligning member 46 with the toner monitor. Member 46 simulates a nominal toner concentration to the toner monitor. During start up, the output signal of the toner monitor when aligned with member 46 is stored in memory in central processing unit 38 as a base value. From time-to-time during operation, the output signal of the toner monitor when aligned with member 46 is compared to the base value. Any difference between the output of the monitor and the base value is applied to central processing unit 38, which compensates future signals from the toner monitor accordingly.

Thus, the toner monitor is installed at a fixed location, and multiple toning stations travel and reside alternatively above it. Reference member 46 permits the controller to detect shifts of the output signal of the toner monitor caused by changing environment. Since the magnetic permeability of member 46 may vary from machine to machine, the auto zeroing procedure is used during start up. Whenever the system detects the installation of a new development station, the system will read and store a new base value for that development unit.

The first reading for member 46 for each new development unit will be stored as a base value. The difference between the first reading and later readings will be added to or subtracted from the later reading of that station to compensate the output change of the sensor due to environment change.

The invention has been described in detail with particular reference to preferred embodiments thereof, but it will be understood that variations and modifications can be effected within the spirit and scope of the invention.

What is claimed is:

1. An electrostatographic machine comprising:

at least one development unit having a chamber containing a developer mixture of carrier particles and toner particles in a predetermined desired concentration;

monitor means for producing a signal representative of the concentration of toner particles in the developer mixture in the chamber;

means, independent of said developer mixture, for simulating to said monitor means an environmentally stable predetermined toner concentration such that said monitor means produces a signal having a value corresponding to the predetermined toner concentration; and means for comparing the value of the signal corresponding to the predetermined toner concentration to a stored base value to produce an indication of the calibration of the monitor means.

2. An electrostatographic machine as defined in claim 1 wherein said base value is determined by sensing the signal of said monitor means.

3. An electrostatographic machine as defined in claim 2 wherein said base value is determined during machine start up.

4. An electrostatographic machine as set forth in claim 1 further comprising means for calibrating the monitor means to compensate for differences between the value of the signal corresponding to the predetermined toner. concentration and the stored base value.

5. An electrostatographic machine as set forth in claim 1 wherein said means for simulating a predetermined toner concentration comprises a member alignable with said monitor means for simulating a nominal toner concentration to the monitor means.

6. An electrostatographic machine as set forth in claim 5 wherein:

said member alignable with said monitor means has a known magnetic permeability; and said stored base value corresponds to the expected value for a toner concentration having the same magnetic permeability.

7. An electrostatographic machine comprising:

a plurality of development units each having a chamber containing a developer mixture of carrier particles and toner particles in a predetermined desired concentration;

monitor means selectively alignable with each of the development units for producing a signal having a value representative of the concentration of toner particles in the developer mixture in the chamber of the aligned development unit;

means independent of said developer mixture, for simulating to said monitor means an environmentally stable predetermined toner concentration such that said monitor means produces a signal having a value corresponding to the predetermined toner concentration; and means for comparing the value of the signal corresponding to the predetermined toner concentration to a stored base value to produce an indication of the calibration of the monitor means.

8. An electrostatographic machine as set forth in claim 7 wherein said means for simulating a predetermined toner concentration comprises a member alignable with said monitor means for simulating a nominal toner concentration to the monitor means.

9. An electrostatographic machine as set forth in claim 8 wherein:

said member alignable with said monitor means has a known magnetic permeability; and said stored base value corresponds to the expected value for a toner concentration having the same magnetic permeability.

10. A developing device for applying toner to an electrostatic image carried on an image member as said electrostatic image moves through a developing position, said developing device comprising:

a plurality of developing units, each unit including an applicator and a housing which housing includes means for supplying a developer mixture of carrier and toner particles to said applicator, each of said units being movable to a position aligned with said developing position;

monitor means aligned with the developing unit which is aligned with said developing position for producing a signal having a value representative of the concentration of toner particles in the developer mixture of said aligned developing unit:

means independent of said developer mixture, for simulating an environmentally stable predetermined toner concentration to said monitor means such that said monitor means produces a signal having a value corresponding to the predetermined toner concentration; and means for comparing the value of the signal corresponding to the predetermined toner concentration to a stored base value to produce an indication of the calibration of the monitor means.

11. A developing device as defined in claim 10 wherein said base value is determined by sensing the signal of said monitor means.

12. A developing device as defined in claim 11 wherein said base value is determined during machine start up.

13. A developing device according to claim 10 wherein said developing units are movable as a unitary component through a path which aligns each unit with the developing position one after another to tone a series of electrostatic images with different toners.

14. A developing device according to claim 13 including means for aligning the monitor means with the means for simulating a predetermined toner concentration during movement of said developing units through said path.

15. A developing device according to claim 14 wherein each unit includes a toner of a different color.

16. A developing device for applying different color toners to different electrostatic images carried by the surface of a rotating drum as said drum moves through a single fixed development position, said development device comprising:

a plurality of development units, each unit containing a toner of a color different from the other units, said units being fixed in a side-by-side arrangement in a movable carriage, said carriage being movable in a lateral direction bringing the applicator of each unit through a position in which it is aligned with said development position;

monitor means aligned with the developing unit which is aligned with said developing position for producing a signal having a value representative of the concentration of toner particles in the developer mixture of said aligned developing unit;

means independent of said developer mixture, for simulating an environmentally stable predetermined toner concentration to said monitor means such that said monitor means produces a signal having a value corresponding to the predetermined toner concentration; and means for comparing the value of the signal corresponding to the predetermined toner concentration to a stored base value to produce an indication of the calibration of the monitor means.

17. A developing device as defined in claim 16 wherein said base value is determined by sensing the signal of said monitor means.

18. A developing device as defined in claim 17 wherein said base value is determined during machine start up.

19. A developing device for applying toner to an electrostatic image carried on an image drum as, said image moves through a development position located generally at the bottom of said drum, said development device comprising:

a plurality of developing units, fixed in horizontal side-by-side relation on a movable carriage, each unit having a development chamber for holding two-component developer, means for mixing developer in said chamber and an applicator at the top of the chamber for presenting developer to a development position above said unit;

means for driving said carriage through a generally horizontal path to move each unit, one after another, through a position directly below the development position of said drum;

monitor means aligned with the developing unit which is aligned with said developing position for producing a signal having a value representative of the concentration of toner particles in the developer mixture of said aligned developing unit;

means independent of said developer mixture, for simulating an environmentally stable predetermined toner concentration to said monitor means such that said monitor means produces a signal having a value corresponding to the predetermined toner concentration; and means for comparing the value of the signal corresponding to the predetermined toner concentration to a stored base value to produce an indication of the calibration of the monitor means.

20. A developing device according to claim 19 including a control means for controlling the driving means to drive said carriage from a start position in a first direction and to stop said carriage with each unit directly below said development position for enough time for each unit to develop a single electrostatic image carried by said drum and after all units have developed an electrostatic image to move said carriage back to said start position.

* * * * *